United States Patent [19]

Church et al.

[11] 4,078,791

[45] Mar. 14, 1978

[54] GATE MECHANISM FOR A COPIER MACHINE

[75] Inventors: Wayne Edward Church, Longmont; Frederick Fenn Quist, Jr., Boulder, both of Colo.

[73] Assignee: International Business Machines Corporation, Armonk, N.Y.

[21] Appl. No.: 777,795

[22] Filed: Mar. 15, 1977

[51] Int. Cl.[2] ..... B65H 9/04

[52] U.S. Cl. ..... 271/227; 271/245; 271/265

[58] Field of Search ..... 271/227, 245, 246, 243, 271/265, 244; 355/14

[56] References Cited

U.S. PATENT DOCUMENTS 3,630,519 12/1971 Spear ..... 271/246

3,888,478 6/1975 Alderman ..... 271/245 X

*Primary Examiner*—Richard A. Schacher

*Attorney, Agent, or Firm*—Charles E. Rohrer

[57] ABSTRACT

A gate for allowing copy paper to pass at a selected one of a plurality of points in a copy cycle so that the leading edge of the copy paper mates with the leading edge of an image. The gate control mechanism includes a solenoid responsive to specific points in the copy cycle and to different sizes of copy paper such that the solenoid is actuated at different points in the copy cycle dependent upon the size of copy paper. The solenoid moves a gate arm which positions an interposer in a first position whereby it is struck by one of a plurality of tabs. The interposer is moved by the tab, causing a pivot shaft to rotate, thus releasing a pawl and allowing the gate shaft to rotate opening the gate.

3 Claims, 11 Drawing Figures

GATE MECHANISM FOR A COPIER MACHINE

This invention relates to electrophotographic copier machines, and more particularly to a gate mechanism for releasing copy paper to mate the leading edge of the copy paper with the leading edge of an image.

BACKGROUND OF THE INVENTION

In electrophotographic machines which utilize plain paper, the image of an original document to be copied is placed onto a photoconductive surface which has been electrically charged. Light received from the image discharges the photoconductor according to the darkness of the original, thus leaving an image of the original on the photoconductor. The photoconductor is then developed, typically by the deposition of a black powder, and the developed image is transferred to plain copy paper. If the image of the original occupies an area of 8 ½ × 11 inches and if the copy paper size is 8 ½ × 11 inches, obviously the edges of the copy paper must be mated with the edges of the image in order to transfer the entire image without loss of information.

In prior art machines it has been customary to locate the leading edge of the image along the same line on the surface of the photoreceptor from copy to copy. Thus, a gate mechanism may be provided to release the copy paper to reach the photoreceptive surface in a manner designed to always mate the leading edge of the copy paper with that same line on the photoreceptor surface. However, it has been found that is some copier machine configurations wherein scanning optics are utilized and wherein the original document is referenced along a common edge or common edges, it is necessary to scan the document from the unreferenced edge toward the referenced edge. Because of that necessity, a 14-inch document is viewed three inches earlier during the scan than is the 11-inch document. As a consequence, the leading edge of the 14-inch image appears at the transfer station three inches sooner than the leading edge of the 11-inch image. As a result, the 14-inch copy paper must be released to mate with the leading edge of the 14-inch image sooner in the copy cycle than the 11-inch paper. The primary object of this invention is to provide a gate control mechanism which releases copy paper to mate with the leading edge of images at more than one position on the drum surface, thus providing a capability to variably locate the image leading edge at a number of particular drum locations.

SUMMARY OF THE INVENTION

A gate control mechanism for opening a gate at a selected one of a plurality of repeatable positions in a copy cycle such that various size copy paper can pass to mate with a correspondingly sized image in order to receive said image without loss of information.

BRIEF DESCRIPTION OF THE DRAWINGS

The above-mentioned and other features and objects of this invention and the manner of attaining them will become more apparent and the invention itself will best be understood by reference to the following description of embodiments of the invention taken in conjunction with the accompanying drawings, the description of which follows.

DETAILED DESCRIPTION OF AN EMBODIMENT

Figure 1:
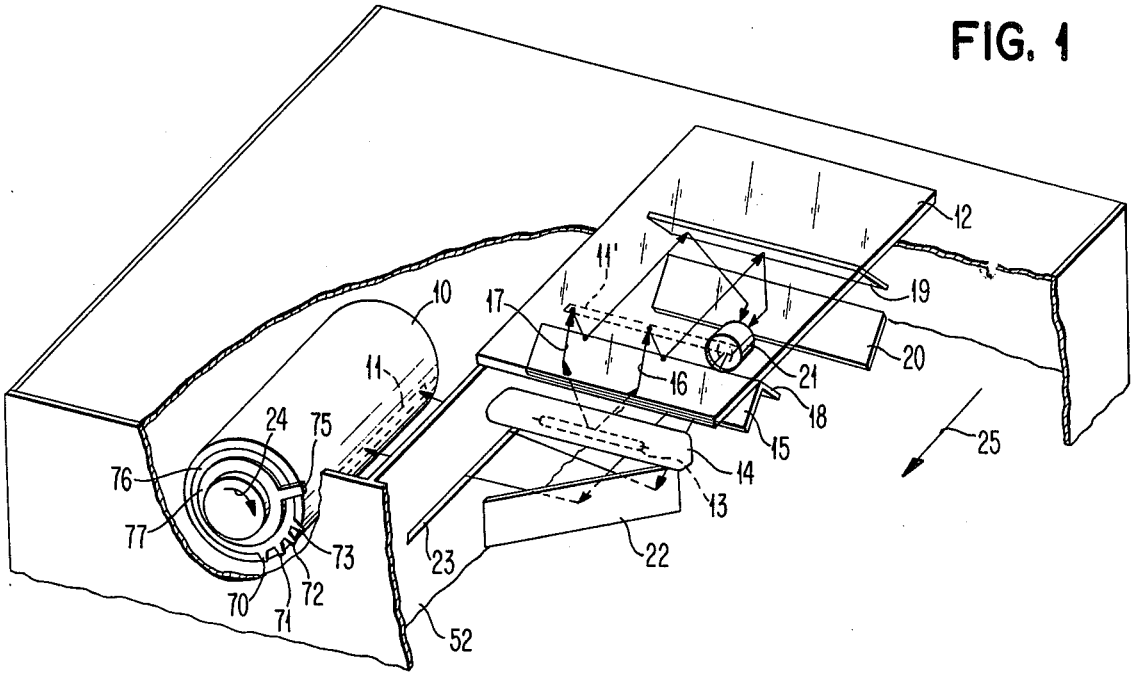
FIG. 1 shows a diagrammatic perspective view of a scanning system for use in a document copier.

FIG. 1 shows a document copier machine utilizing a scanning system to lay down a line of light (footprint) 11 on a rotating drum 10. Drum 10 is covered with a photoreceptive surface which is charged by a corona mechanism (not shown) such that when the light comprising footprint 11 strikes the surface of the photoreceptor, it discharges the photoreceptor according to the amount of light in the footprint. FIG. 1 shows a document glass 12 upon which documents to be copied are placed. A document is not shown on plate 12 in FIG. 1 so that the optical scanning elements located below the document glass may be readily viewed.

The scanning optical system operates as follows. A light source 13 is disposed within a reflector 14 and provides rays of light which are directed to the document glass by reflective surface 15. Two of these rays of light, 16 and 17, are shown emanating from light source 13, striking mirror 15 and being reflected to document glass 12 as a part of the footprint 11'. At the document glass 12 the rays of light in footprint 11' strike the document to be copied and are reflected back down to mirror 18, from whence the light rays are reflected to mirror 19 to mirror 20 and through the lens 21. From lens 21 the light rays pass to a final mirror 22 from whence they are reflected through opening 23 to form the footprint 11 on drum 10.

The footprint 11' is caused to scan across exposure plate 12 from one end of the plate toward the other so that the entirety of the document placed upon plate 12 is exposed to rays of light from source 13. Also, the photoreceptive surface mounted upon drum 10 is rotated at a speed which is equal to the scan speed at which the footprint 11' is moved across the document glass. In that manner a 1:1 reproduction of the original may be produced on the photoreceptor.

In order to move the footprint of light 11' across the document glass 12, light source 13 and mirrors 15 and 18 are mounted on a carriage which moves underneath the glass at the scan speed. Similarly, mirrors 19 and 20 are located on a second carriage which moves beneath the document glass at a speed one-half that of the first carriage. In that manner, the footprint of light 11' is caused to traverse the document glass from one end to the other while maintaining the optical path length between the footprint 11' and lens 21 constant throughout the scanning motion. Many scanning optical systems for copier machines exist in the prior art and therefore the details of such a scanning operation will not be discussed herein. Reference may be made to copending U.S. Patent Application Ser. No. 721,125; filed Sept. 7, 1976, for a particularly outstanding scanning mechanism.

FIG. 1 also shows an end plate 76 located on drum 10, with tabs 70, 71, 72, and 73 thereon. A second end plate 77 is also shown with a tab 75 attached thereto. The purpose of these tabs will be explained hereinbelow.

Figure 2:
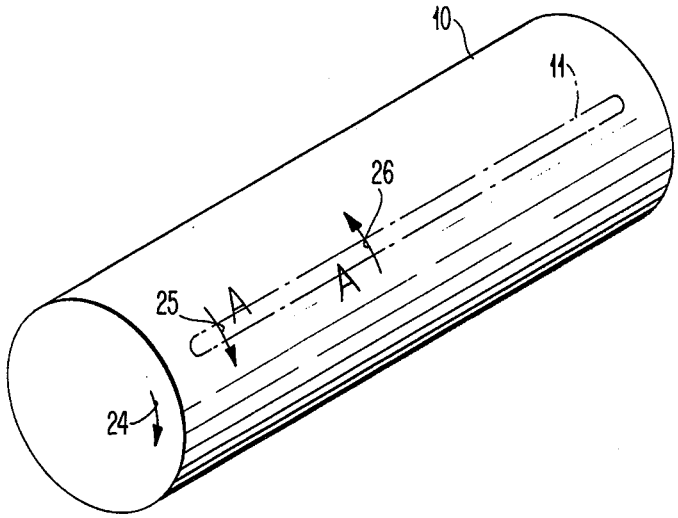
FIG. 2 illustrates the need for matching the scanning direction with the direction of rotation of the drum.

FIG. 2 shows the drum 10 and the footprint 11 with two rather over-sized letter "A's" located partially within the footprint 11. The direction of rotation of drum 10 is shown by arrow 24 and a first direction of scan movement is indicated by arrow 25. The purpose of FIG. 2 is to illustrate that the direction of scan must match the direction of rotation of the drum, such as is shown by arrows 24 and 25, for the imaging operation to be successful. Conversely, where the direction of scan is opposed to the direction of rotation of the drum such as shown by arrow 26 for imaging operation is not successful. Suppose now that a letter "A" is to be copied from the original onto the photoreceptor and that the bottom portion of the letter "A" is in the footprint area as shown near the arrow 25 on FIG. 2. If the letter "A" on the original document is being scanned in direction 25 then the bottom portion of the letter is seen first and gradually footprint 11 will contain the upper portion of letter "A." Since the photoreceptor is turning in direction 24, a portion of the photoreceptor containing the bottom of 11*a* is moved out of the footprint area as the top portion is moved in. Thus, the direction of scan and the direction of drum rotation are matched to produce a letter "A" on the photoreceptor in proper form. Note that this calls for moving, by means of the scan, the information in footprint 11′ from the top of the footprint to the bottom. Suppose, however, that the direction of scan is as shown by arrow 26. In this case the top portion of the letter "A" will be carried as a streak throughout the entirety of the footprint area and similarly the remainder of the letter "A" will also appear as a streak through the footprint area. The result will be an unintelligible version of the letter "A." Thus, in FIG. 1, if the drum is to rotate in the direction 24, the direction which the scanning carriages must take is shown by the arrow 25.

Figure 3:
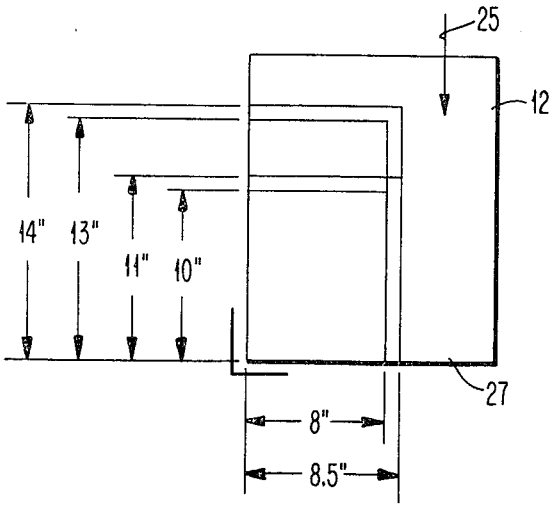
FIG. 3 shows four typical sizes of copy paper positioned on a document glass.

Referring now to FIG. 3, the document glass 12 is shown with four sizes of paper positioned thereon. If a common reference edge is edge 27, then the scanning carriages traveling in direction 25 begin to "see" the leading edges of documents at different times depending upon the size of the document placed upon the document glass 12. Therefore, by the selection of reference edge 27 as the most convenient edge against which the machine operator can reference his documents, and by selection of drum rotation direction 24, a scan is necessitated in the direction 25. Consequently, a situation is produced in which the leading edge of the image is not necessarily located at the same position on the photoreceptive surface but depends upon the size of the original placed upon the document glass 12.

In FIG. 3 four common sizes of documents used in the U.S. are shown, i.e., the customary 8 ½ × 11, the standard U.S. Government size of 8 × 10, legal-size paper 8 ½ × 14, and U.S. Government size legal paper 8 × 13. Therefore, if 1:1 copies of each of these sizes of paper are to be made in the copy machine, four different sized copy papers must be used and importantly, each of these copy papers will have to reach the transfer station of the machine at a different point in the machine cycle in order that the leading edge of the copy paper mates with the leading edge of the image.

Figure 4:
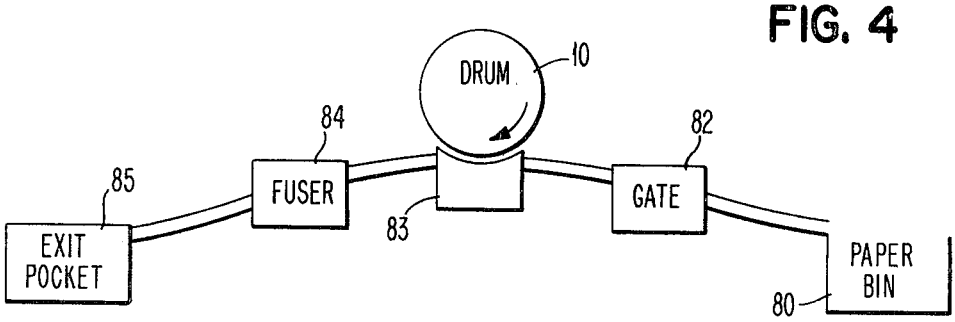
FIG. 4 is a diagrammatic representation of a paper path in a copier machine.

FIG. 4 shows the major elements in a typical paper path in an electrophotographic machine of the transfer type. A paper bin 80 is shown into which the copy paper is placed. The paper is fed out of that bin one at a time along the paper path 81 to a gate mechanism 82. When the proper point in the rotation of the drum 10 is reached, gate 82 opens, allowing the copy paper to move to the transfer station 83 such that the leading edge of the copy paper mates with the leading edge of the image. Transfer is effected at the transfer station 83 after which the copy paper bearing the image of the original is fed into a fusing station 84. Thereafter the copy paper is sent to an exit pocket 85 so that the operator can retrieve the produced copy. In the instant invention, the gate 82 must have the capability of operating at different times in the drum cycle so that different sized copy papers may be released to mate with correspondingly sized images at the proper time during drum rotation.

Figure 5:
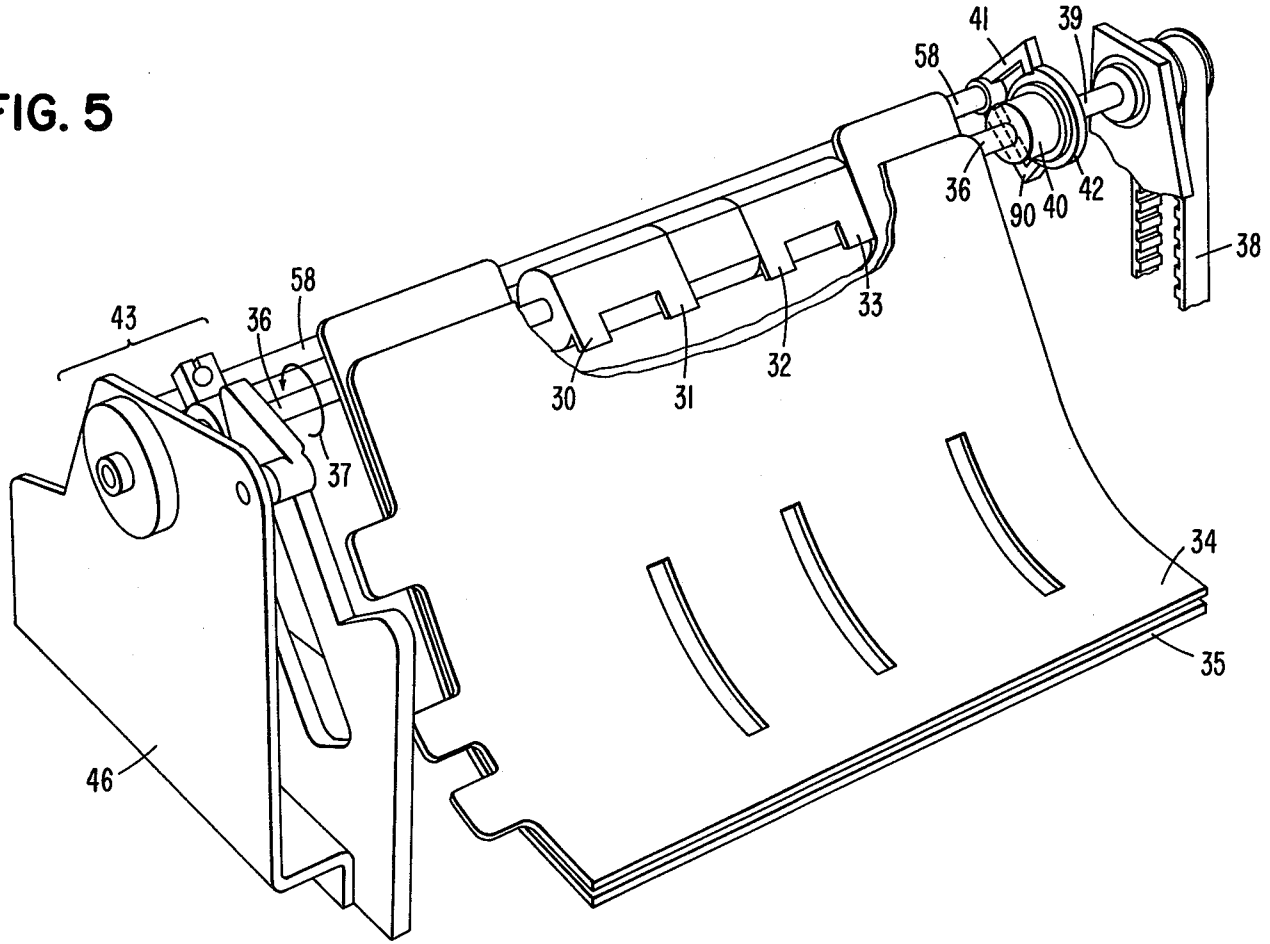
FIG. 5 is a perspective view of the gate mechanism together with part of the paper path.
Figure 6:
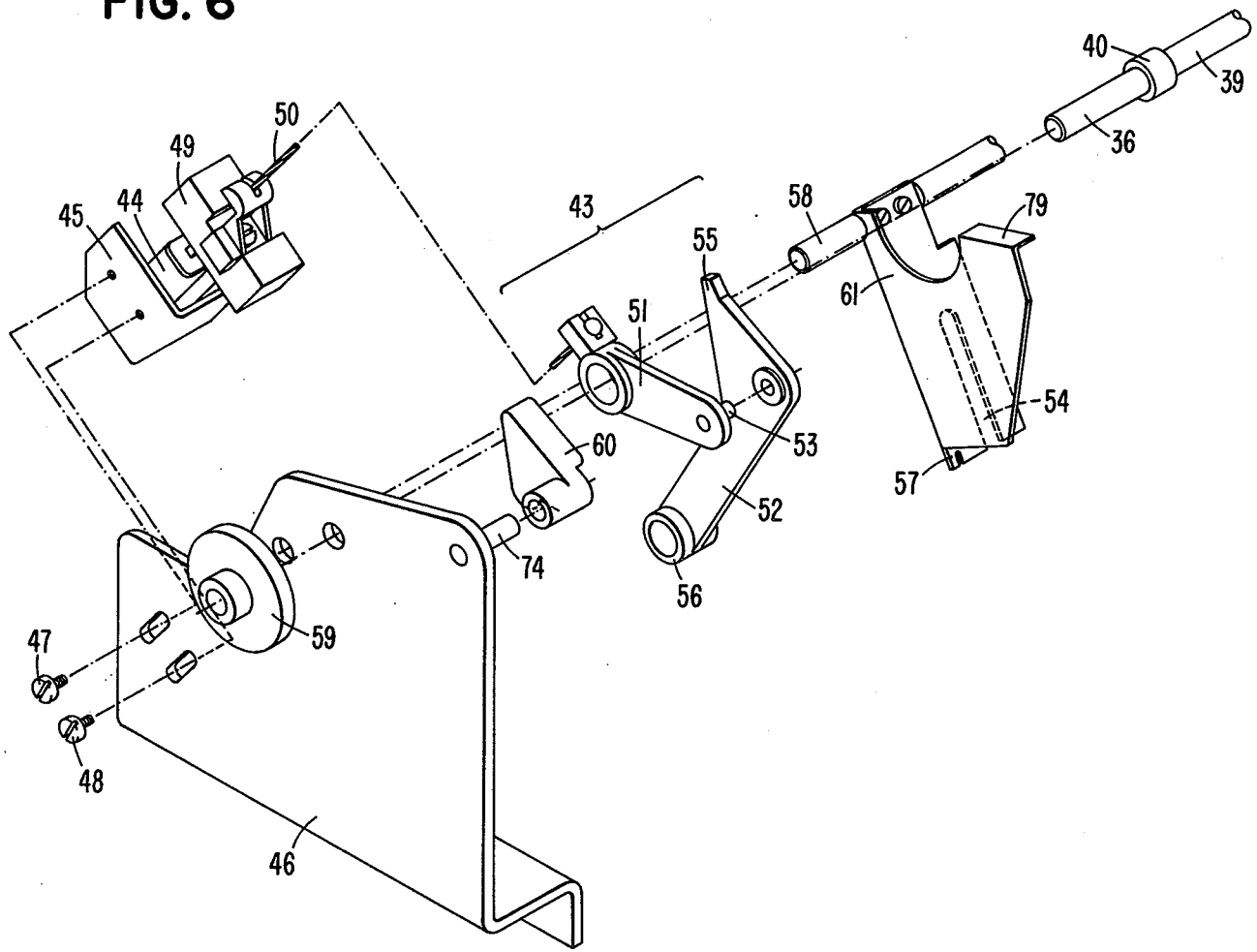
FIG. 6 is an exploded view of the gate mechanism shown in FIG. 5.

A preferred embodiment of the invention is shown in FIGS. 5 and 6. In FIG. 5 gate fingers 30, 31, 32, and 33 are shown in a position such that the leading edge of a copy paper passing between plates 34 and 35 is caught by the fingers and held in position until such time that the gate is opened. To open the gate, gate shaft 36 is rotated in direction 37 such that fingers 30–33 are moved out of the paper path and the paper is allowed to continue through to the transfer station and beyond. Rotation of gate shaft 36 is provided from a power source (not shown), belt 38, shaft 39 and slip clutch 40. A pawl 41 rides on a cam 42 to set slip clutch 40 to prevent transmission of motion from continually rotating shaft 39 to shaft 36. When pawl 41 is released through rotation of pivot shaft 58, cam 42 is allowed to rotate with shaft 39, causing shaft 36 to rotate with it. The gate control mechanism which operates shaft 58 at the right instant to open the gate is located generally at 43. The details of this mechanism are shown in the exploded view in FIG. 6.

FIG. 6 shows a solenoid 44 held in a frame 45 which is mounted to an exterior plate 46 by screws 47 and 48. Upon energization of solenoid 44 armature 49 is pulled downwardly, causing cable 50 to rotate gate arm 51. Gate arm 51 is slidably mounted on shaft 36 and is connected to interposer 52 by means of a pin 53. Interposer 52 fits into a slot 54 in pivot arm 61 such that the cam follower 56 at the bottom of interposer 52 rides on the cam surface 57 which is the backside of pivot arm 61 as shown in FIG. 6. Note that interposer 52 carries a projecting end tab 55. The gate shaft 36 is shown in FIG. 6 as well as power shaft 39 and the spring-type slip clutch 40. Pawl 41 and cam 42 are not shown in this view; however, pivot shaft 58 by which pawl 41 is operated is shown. A detent device 59 is used to allow proper unlatching of the spring clutch 40. The return cam 60 is shown together with a cooperating cam surface 79 which is a part of pivot arm 61.

Figure 7A:
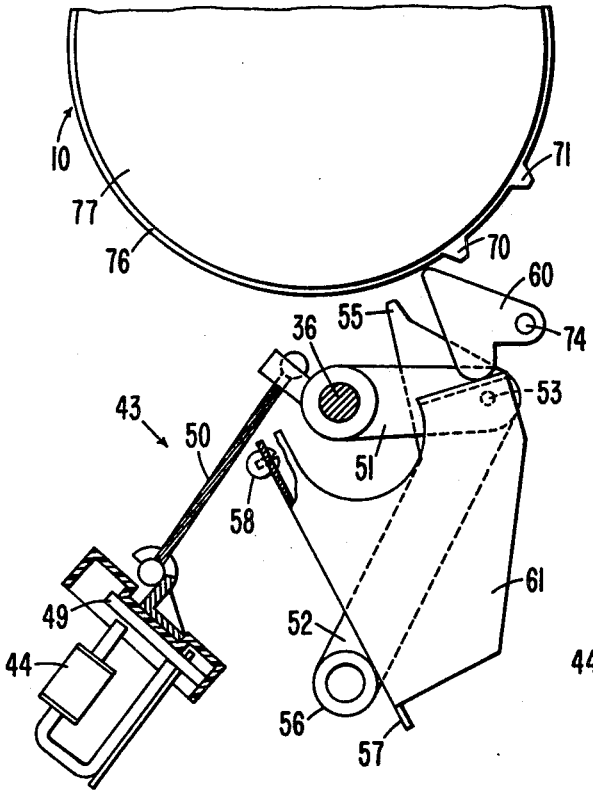
FIGS. 7A–7D show the gate actuating mechanism in various positions during device operation.
Figure 7B:
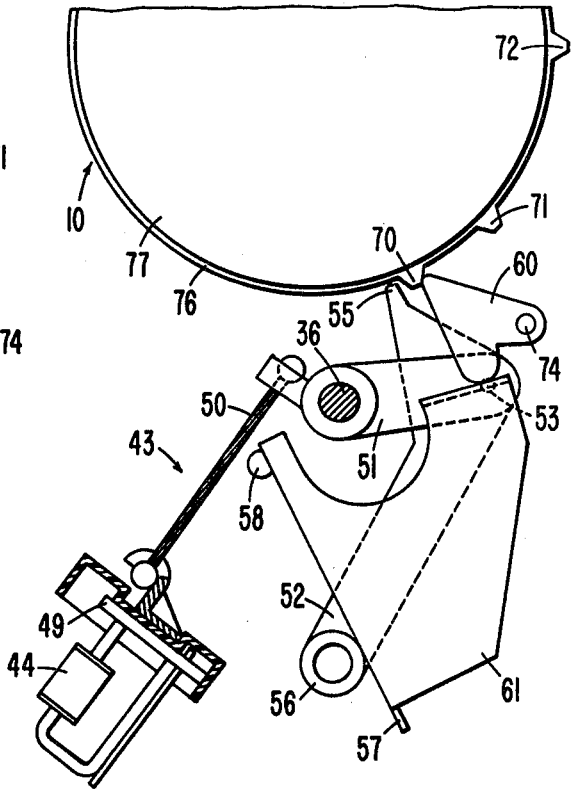

FIGS. 7A–7B show the gate control mechanism 43 at various positions during the cycling of the drum. In FIG. 7A the gate control mechanism 43 is shown in what may be termed a "rest" position which corresponds to the closed position of the gate fingers 30–33 as they are shown in FIG. 5. That is, the gate fingers are in position to receive a sheet of copy paper and hold that sheet until the signal for releasing the paper is received. In FIG. 7A the solenoid 44 is de-energized and armature 49 is held open under the influence of the weight of arm 51 and interposer 52. Note that the interposer tab 55 is dropped away from the drum to a position such that it will not be struck by either tab 70, tab 71 or any of the other tabs located on the end plate 76. It should also be observed that return cam 60 is in a different vertical plane than tabs 70 and 71 and hence return cam 60 will not be struck by those tabs during the rotation of drum 10.

In FIG. 7B a signal has been received by the solenoid 44 to position the tab 55 so that it will be struck by tab 70. Armature 49 is now closed resulting in the rotation of gate arm 51 around shaft 36 causing a movement of pin 53 and hence interposer 52 to lift the tab 55 into position.

Figure 7C:
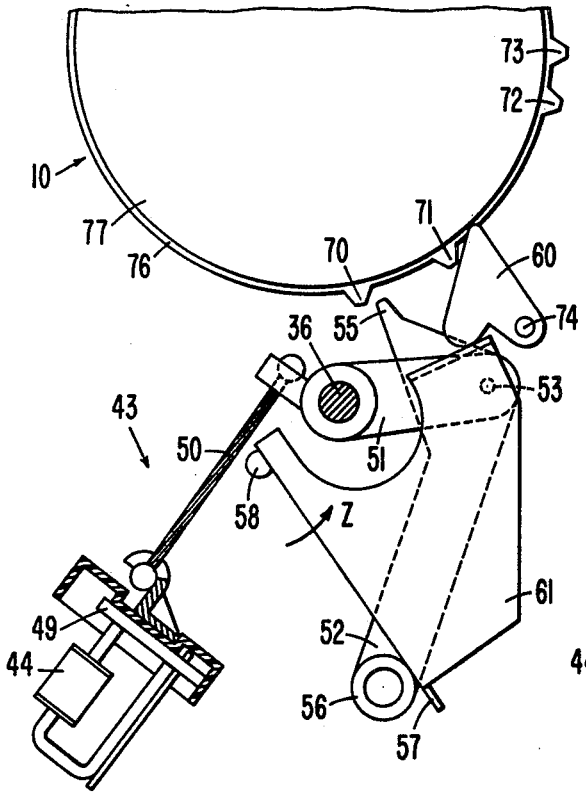

In FIG. 7C rotation of drum 10 has brought the tab 70 into contact with tab 55 and has rotated just beyond that contact position. The result is to shift the interposer 52 around a pivot point at pin 53 causing the cam follower 56 to bear against the cam surface 57 of pivot arm 61. As a result pivot arm 61 rotates in direction Z around shaft 58 and since pivot arm 61 is rigidly attached to gate shaft 58 (see FIG. 7A), this movement causes a rotation of shaft 58. Referring now to FIG. 5, note that rotation of shaft 58 moves pawl 41, releasing cam 42 and allowing slip clutch 40 to join shafts 39 and 36 in joint rotation. As a consequence, gate fingers 30–33 are rotated and the copy paper is released to advance to the transfer station. Gate shaft 36 rotates for part of a complete revolution, stopping when the second prong 90 of pawl 41 is reached by the abrupt rise of cam 42; at that point slippage again occurs in clutch 40.

Figure 7D:
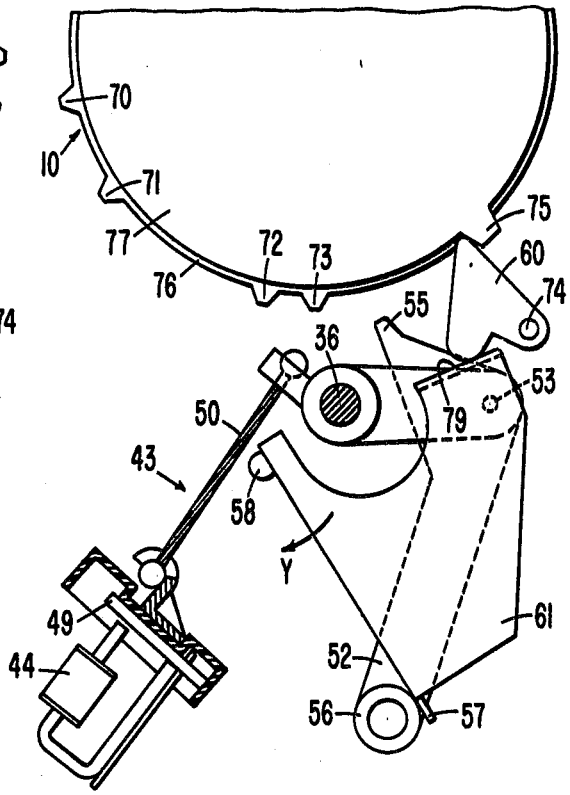

Continued rotation of drum 10 brings the return tab 75 in contact with the return cam 60, as shown in FIG. 7D, causing a rotation of return cam 60 around its pivot 74. The result is that cam 60 bears against the cam surface 79 of pivot arm 61 to cause a rotation of arm 61 around shaft 58 to its original position, i.e., the position shown in FIG. 7A. Again, since pivot arm 61 is rigidly connected to shaft 58, that shaft is rotated in direction Y causing pawl 41, shown in FIG. 5, to release clutch 40 and cause rotation of shaft 36 until the first prong of pawl 41 again catches the abrupt rise in cam 42, thus moving gate fingers 30–33 to the orientation shown in FIG. 5 in position to receive the next sheet of copy paper.

The return of gate arm 51 to its original position comes simply through the release of armature 49 through de-energization of solenoid 44. De-energization of solenoid 44 can occur at any time after the tab has struck the interposer either before or after the operation of the return cam by tab 75. Pivot arm 61 is held in either of its two positions by an overcenter spring, not shown for simplicity.

Figure 8:
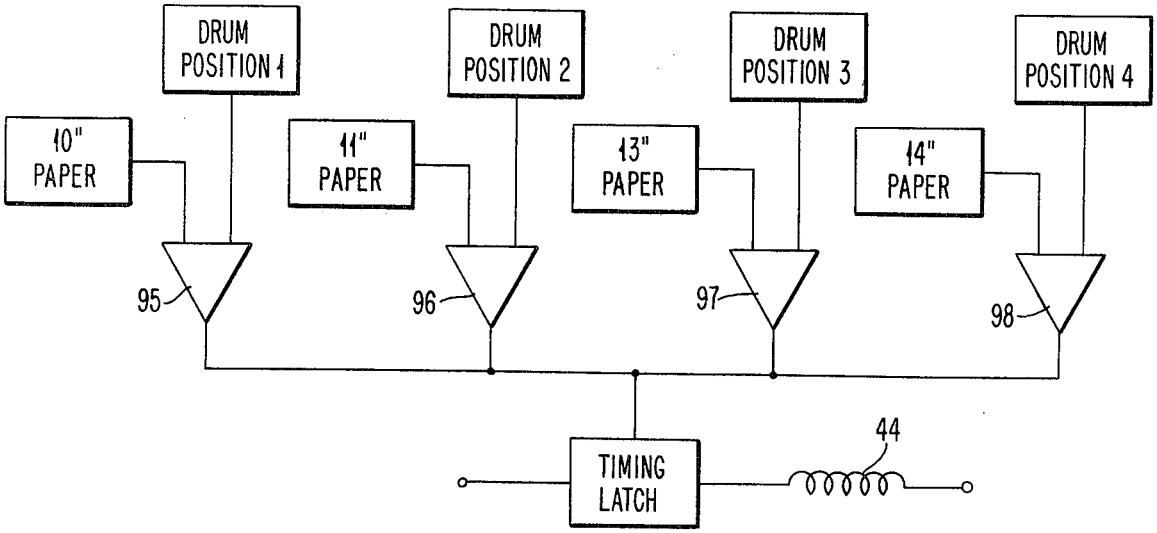
FIG. 8 shows the sensing switches and associated circuitry.

It should be noted that four separate tabs, 70–73, are located on end plate 76 mounted on drum 10. Each of these tabs can be selected to operate the gate control mechanism. For example, if tab 71 is to be selected, the solenoid 44 is not energized until after tab 70 has passed a position at which it would strike the interposer tab 55. The only constraint is that there must be sufficient spacing between tabs 70 and 71 to allow the interposer to be lifted into position during the time interval between passage of tabs 70 and 71. Similarly, tab 72 or 73 could be used to initiate the action of the gate control mechanism. The purpose of the four different tabs 70–73 is to release the gate at four different points in the cycling of the drum such that the copy paper is released to mate with the image at the transfer station at four different points in the copy cycle. In this manner the mechanism meets the objects of the invention in that four different sized copy papers such as those mentioned in relation to FIG. 3, can be accomodated on the machine. Obviously, different numbers of tabs can be provided if desired. The selection of the tab to be used for initiating the opening of the gate is obviously dependent upon the size of the copy paper in the machine. Consequently, energization of solenoid 44 is controlled through switches which sense the size of copy paper and switches which sense the position of the drum such as shown in the circuit of FIG. 8. Thus, if 10-inch paper is in the machine, AND circuit 95 is satisfied when the drum reaches a certain position 1 in the copy cycle. This results in the energization of solenoid 44 and the positioning of interposer tab 55. The switch to sense position 1 is situated such that tab 55 is positioned just prior to the passage of drum tab 70. In a similar manner, solenoid 44 is energized through AND circuits 96–98 to position interposer tab 55 just prior to passage of tabs 71–73.

The embodiment illustrated above is in the context of a transfer-type, plain paper machine utilizing scanning optics and a drum. However, the invention may also be employed in other types of copier machines such as, e.g., a coated paper machine where the leading edge of the image is made up of the rays of light comprising the footprint itself. Essentially, the invention may be used in the paper path of any machine where the leading edge of the image occurs at different but repeated positions in the machine cycle.

While the invention has been particularly shown and described with reference to a preferred embodiment thereof, it will be understood by those skilled in the art that the foregoing and other changes in form and details may be made therein without departing from the spirit and scope of the invention.

What is claimed is:

1. In an electrophotographic machine for producing copies of original documents by cycling through successive operations in a copy cycle, said machine including an optical imaging means for producing an image of an original document to be copied, a copy paper supply, means to move sheets of copy paper one at a time to a gate means, said gate means for intercepting the sheet of copy paper and holding it in a stationary position, a gate control mechanism for operating said gate means to release said sheet of copy paper at the proper time in said copy cycle so that the leading edge of said image and the leading edge of said copy paper are mated, whereby an image equal in size to the size of a sheet of copy paper appears on said copy paper without loss of information, said gate control mechanism comprising:

apparatus responsive to the cycling of said machine for selectively opening said gate means at one of a plurality of specific points in said copy cycle, the point of selected gate opening being repeatable from cycle to cycle, whereby various size copy paper can be fed to mate with correspondingly sized images.

2. The gate control mechanism of claim 1 wherein said apparatus comprises:

a solenoid-actuated gate arm, said solenoid responsive to the cycling of said machine;

an interposer means mechanically positioned by the movement of said gate arm to a first position; and a plurality of tabs situated on said machine to strike said interposer means at the same point in each cycle if said interposer is in said first position, to move said interposer to a second position.

3. The gate control mechanism of claim 2 further including a pivot arm moved about its pivot point by the movement of said interposer to said second position, a pivot shaft rigidly connected to said pivot arm, said pivot shaft rotated when said pivot arm is moved by said interposer, a pawl mounted on said shaft and rotated with said shaft, a cam released for movement by the rotation of said pawl, a slip clutch, a power source, a gate shaft on which said gate means and said cam are mounted, said gate shaft connected to said power souce by said slip clutch when said pawl releases said cam, whereby said gate means is rotated on said gate shaft to open said gate and allow said copy paper to pass.

* * * * *